United States Patent [19]

Hans

[11] Patent Number: 4,751,823

[45] Date of Patent: Jun. 21, 1988

[54] CONTROL ARRANGEMENT AFFECTING OPERATION, SAFETY AND EFFICIENCY OF A HEAT RECOVERY SYSTEM

[76] Inventor: Walter A. Hans, 9 Locust Crt., Maple Shade, N.J. 08052

[21] Appl. No.: 783,137

[22] Filed: Oct. 2, 1985

[51] Int. Cl.[4] ..... F25D 17/02

[52] U.S. Cl. ..... 62/201; 62/238.6; 237/2 B

[58] Field of Search ..... 62/238.6, 201; 165/39, 165/40; 237/2 B

[56] References Cited

U.S. PATENT DOCUMENTS

| | | | |
|---|---|---|---|
| 2,647,730 | 8/1953 | Teague, Jr. | 165/11.1 |
| 3,007,681 | 11/1961 | Keller | 165/103 X |
| 4,251,996 | 2/1981 | Esformes et al. | 62/188 |
| 4,373,346 | 2/1983 | Hebert et al. | 62/238.6 X |
| 4,398,397 | 8/1983 | Hans | 62/238.6 |

*Primary Examiner*—William E. Wayner
*Attorney, Agent, or Firm*—Finnegan, Henderson, Farabow, Garrett & Dunner

[57] ABSTRACT

A control arrangement for a heat recovery system which can be retrofitted onto existing equipment in order to utilize otherwise wasted heat. A heat source such as a conventional refrigeration system used as a source of superheated condensible heat exchange medium for supply to a heat recovery system. A liquid medium system, such as a water system is connected to the heat recovery system for receipt of heat transferred. The heat recovery system includes a plurality of heat exchangers connected in series. A control arrangement responsive to the operating conditions and safety of the heat recovery system and to the systems with which it interfaces with respect to its effect on said interfaced systems. The control arrangement further comprises pressure and temperature sensing devices controlling output temperatures of the liquid medium and maintaining proper pressures within the heat exchangers preventing vaporization of liquid, and further maintaining proper working pressures and liquid levels in the refrigeration system.

9 Claims, 1 Drawing Sheet

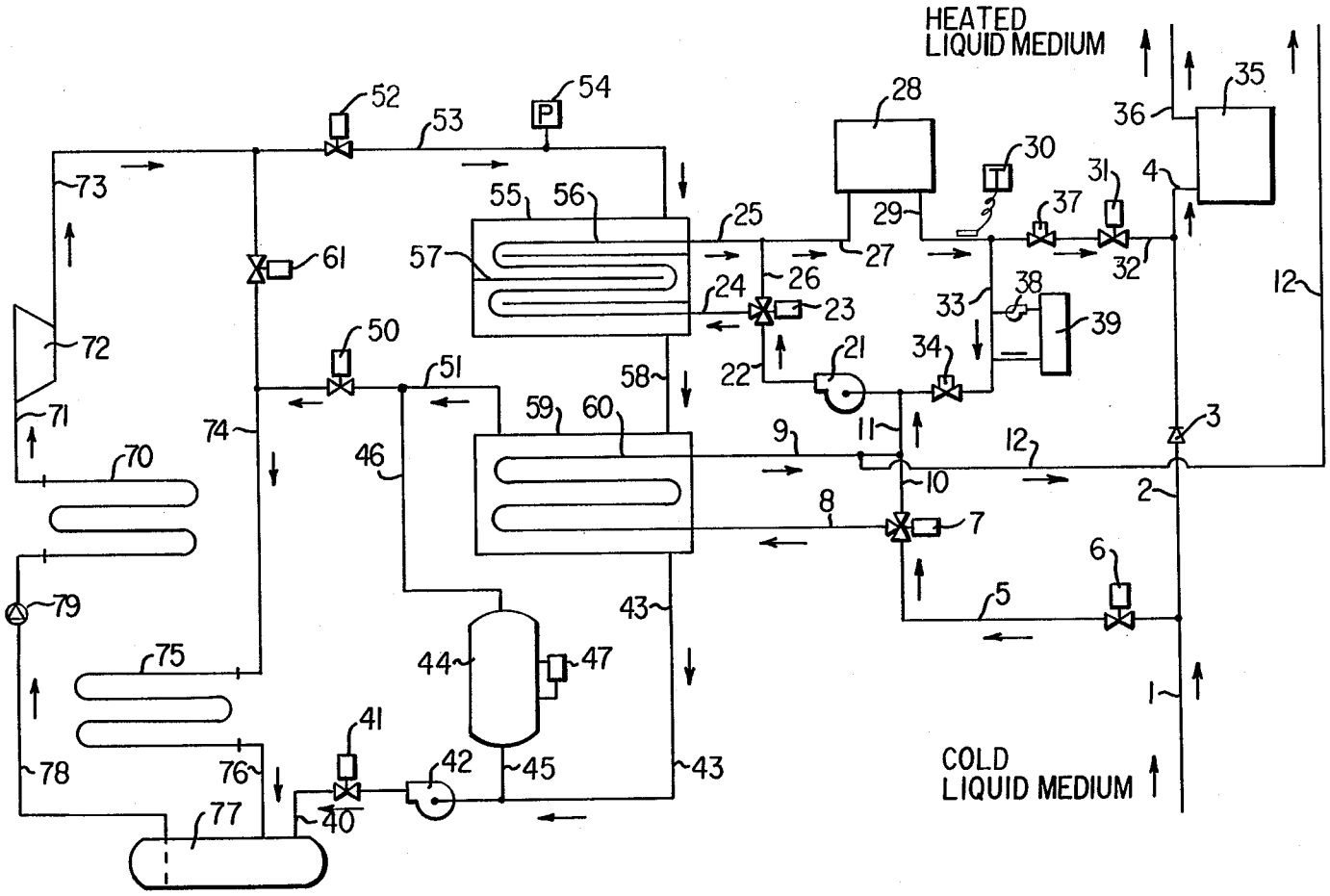
HEATED LIQUID MEDIUM
COLD LIQUID MEDIUM

CONTROL ARRANGEMENT AFFECTING OPERATION, SAFETY AND EFFICIENCY OF A HEAT RECOVERY SYSTEM

FIELD OF THE INVENTION

This invention relates with particularity to a heat recovery system connected to receive a superheated condensible heat exchange medium and a fluid or gas to be heated from a separate fluid or gas medium system, a control arrangement being provided to control the heat recovery system and provide a balance with the systems with which it interfaces. Additionally, the control arrangement disconnects the heat recovery system from the separate superheated condensible heat exchange medium and the fluid or gas medium upon a malfunction in the heat recovery system.

BACKGROUND OF THE INVENTION

Continued increases in energy costs and predictions of future shortages of energy supply have focused attention on the need for conservation in the energy resource area. Considerable effort has been directed toward conserving energy that would normally be discharged in the form of waste. A more common area of energy loss is present in the use of refrigeration systems. These systems dissipate heat withdrawn from the medium to be cooled and the compression energy added to the refrigerant gas into the ambient atmosphere or into cooling water. Up to the present time efforts directed to recapture and make use of these heat losses have been relatively unproductive. This is because the inefficiency of conventional heat recovery systems has greatly limited the amount of transferable energy, thereby making the application of heat recovery systems uneconomical. There are numerous refrigeration systems in current use that continuously discharge useful energy into the ambient atmosphere; energy which could readily be used to heat, for example, cold water for use as boiler feed water, wash water, etc.

A serious problem existing with the use of heat recovery systems in association with a refrigeration system and a separate water heating system or any liquid system in heat exchange relationship with the refrigeration system is the possibility of upsetting the operating conditions necessary for successful operation of either of the separate systems. More specifically, attempts to capture heat generated in refrigeration systems have to be carefully monitored to ensure the preservation of proper operating conditions in the refrigerating system and the liquid system. For example, a sufficient pressure drop across the expansion means in the refrigeration system has to be maintained. In the past, efforts to include the refrigeration system in a heat recovery system for the purpose of heating a separate fluid or gas have been likely to cause an operating imbalance and jeopardize safety in the interconnected systems.

OBJECTS AND SUMMARY OF THE INVENTION

Accordingly, it is an object of this invention to provide a control arrangement for attachment to a heat recovery system, which control arrangement is operative between separate heat supplying systems and heat capturing systems effective to shut down heat recovery between them and preserve operating conditions in each of the respective systems should a malfunction occur in the heat recovery system.

It is an object of this invention to provide a control arrangement instantly separating a heat recovery system from separate refrigeration and fluid or gas medium systems on the malfunction of the heat recovery system.

A further object of this invention is the provision of a control arrangement regulating inlet flow to a plurality of heat exchangers maintaining a constant liquid output temperature preserving the integrity of associated refrigeration and fluid or gas systems.

A still further object of this invention is the provision of a pressure sensor regulating inlet flow of fluid or gas being heated to a heat recovery system maintaining proper operating conditions in a refrigeration system operating as a heat source.

Another object of the subject invention is the provision of switching means sensing an accumulation of liquified gas in the heat recovery system and being responsive to a predetermined fluid level regulating inlet flow to heat exchangers in the heat recovery system preventing excessive condensation of the superheated medium resulting in failure of operation of the refrigerating system.

A still further object of the subject invention is the provision of a recirculating system providing for recirculation of liquid discharged from a first heat exchanger preheating liquid being supplied to a second heat exchanger.

A still further object of the subject invention is the provision of means increasing the hydraulic pressure of liquid being supplied to a first heat exchanger compensating for hydraulic losses in the system.

Another object of the subject invention is the provision of a recirculating system including a pump maintaining liquid pressures sufficient to prevent vaporization of the liquid being heated within a heat exchanger.

A further object of the subject invention is the provision of a recirculating system including valve means proportionally regulating flow from an inlet source of fluid or gas, the proportional flow continually being supplied to a recirculating pump preventing operational failure.

Another object of the subject invention is the provision of thermal storage means in the recirculating system thereby aiding efficiency of a heat exchanger.

It is an object of this invention to control the outlet temperature of a fluid or gas medium being heated by regulating flow of the fluid or gas through a heat recovery system.

A still further object of the subject invention is the provision of a temperature sensing device responsive to fluid or gas medium temperatures as the fluid or gas is discharged from a heat recovery system operable to actuate control valves regulating inlet flow to a plurality of heat exchangers connected in series thereby providing a relatively constant temperature of liquid (fluid or gas) discharged from the recovery system.

It is another object of this invention to assure a minimum pressure for the superheated gas in the refrigeration system providing the necessary pressure drop across expansion means necessary for operation of the refrigeration system.

Another object of this invention is to prevent gas from forming and being trapped in the liquid (fluid or gas) medium while said medium is exposed to the superheated gas in the heat exchanger.

Another object of this invention is to secure liquid medium flow through the pump at all times and thereby protect the pump from overheating.

Another object of this invention is to prevent migration of liquified gas into the heat exchangers of the heat transfer system while the refrigeration system or heat source is not operational.

A further object of this invention is to provide a heat exchange means which transfers heat from the recirculated liquid medium either to another liquid or to a gas such as air.

To achieve these objects, in accordance with the purposes of the invention as embodied and broadly described herein, the control arrangement comprises a control arrangement for instantly separating the heat recovery system from separate refrigeration and fluid or gas medium systems upon a malfunction in the heat recovery system, a temperature sensor for sensing temperature of the discharged fluid or gas and regulating inlet flow to heat exchangers in response to such temperature, a pressure sensor overriding the temperature sensor and positioning control valves in the control arrangement regulating flow of inlet liquid through series connected heat exchangers maintaining proper pressures in the refrigeration system, and a liquid level sensing switch preventing a major portion of refrigeration from becoming liquified and disturbing operating balances in the system.

The accompanying drawing which is incorporated and constitutes a part of the specification, illustrates an embodiment of the invention, the description of which serves to explain the principles of the invention.

BRIEF DESCRIPTION OF THE DRAWING

A single FIGURE is a schematic diagram illustrating the circuitry connections and components of the subject invention.

DETAILED DESCRITPION OF THE PREFERRED EMBODIMENT

With reference to the FIGURE, the subject invention includes a typical refrigeration system, a typical fluid or gas system, and a heat recovery system, all being interconnected by a control arrangement. The heat recovery system interconnects the refrigeration and the (sometimes referred to herein as a fluid or gas system) liquid medium system. The control arrangement is part of the heat recovery system. Description of the refrigeration system, the heat recovery system, and the fluid or gas medium system are for purposes of description only. An example of a heat recovery system that can be utilized is shown in my previous U.S. Pat. No. 4,398,397 issued Aug. 16, 1983. With particular reference to the fluid or gas medium system, an inlet conduit 1 supplies pressurized fluid to a conduit 2 containing a check valve 3. The check valve 3 regulates flow through conduit 4 to a liquid medium heater 35 which discharges fluid through a conduit 36 in a conventional manner. As a primary function check valve 3 opens and allows a portion and/or all of the fluid or gas medium to bypass the heat recovery system if the pressure drop in the heat recovery system becomes excessive and thereby restricts the fluid or gas medium flow or if the heat recovery system is disconnected.

The conduits and components identified as elements 70–79 illustrate a typical refrigeration system which is used as a source of heat in the subject invention as a preferred embodiment. Low pressure gas flows from evaporator 70 through conduit 71 to a compressor 72 where it is compressed to a higher pressure and temperature having added energy which added energy results in superheating the gas. The superheated gas or condensible heat exchange medium normally flows through conduit 73 and 74 to a condensor 75 where it is liquified. The liquified gas is discharged from condenser 75 and flows through conduit 76 to a receiver 77 where it exits conduit 78 and is expanded across expansion means 79 back to evaporator 70.

In accordance with the subject invention, a conduit 53 connects with conduit 73 and directs pressurized superheated gas through a pressure sensing device 54 to an inlet of a first heat exchanger 55. Heat exchanger 55 contains a baffle 57 causing the superheated gas to follow a tortuous path around a coil 56 containing a fluid or gas to be heated which is supplied from a fluid or gas medium system.

The condition of the gas entirely depends upon the balance of heat supplied and heat withdrawn. For example, when three-way valve 23 bypasses all liquid medium, the gas leaves the heat exchanger 55 in the same condition it entered. The other extreme is that the superheated gas is 100% condensed before it leaves heat exchanger 55. Of course, any condition between both extremes is possible.

The partially superheated gas exits heat exchanger 55 through conduit 58 and enters a second heat exchanger 59. Partially superheated gas then flows around a coil 60 also supplied with fluid or gas to be heated. Liquified gas exits the second heat exchanger 59 through a conduit 43 and is directd to an accumulator 44 through a conduit 45. Accumulator 44 collects liquified gas and includes a float switch 47 responsive to liquid levels in the accumulator. The liquified gas is also supplied to a refrigerating pump 42 which takes advantage of a pressure head resulting from liquid level in accumulator 44. Pump 42 discharges pressurized liquified gas through conduit 40 to receiver 77 for recirculation in the refrigeration system. The liquified gas flows through conduit 78 and expands across expansion means 79 reducing the pressure of the gas for flow through evaporator 70 and its ultimate inlet to compressor 72 through conduit 71.

Second heat exchanger 59 is connected by conduit 51 to return line 74 in the refrigeration system. Likewise a conduit 46 connects the upper portions of accumulator 44 with conduit 51 and ultimately return line 74 in the refrigeration system. Any gas not liquified in heat exchangers 55 or 59 will return to the refrigeration system through conduit 51 in the form of either superheated or saturated gas, which then will be either condensed or liquified in condensor 75.

Referring now to the fluid or gas circuitry, fluid or gas (as indicated above, sometimes referred to herein as liquid), which, for example, can be water to be heated, is supplied through conduit 1 and conduit 5 for regulation by a first control valve 7. Control valve 7 is a conventional three-way valve and is actuated in response to operating conditions as will be later described. Liquid flows through valve 7, conduit 8, and enters second heat exchanger 59 in coil 60 where it is initially heated by gas supplied through conduit 58. Liquid is discharged through conduit 9 to a conduit 11 from which it flows to a recirculating pump 21 discharging liquid at an increased pressure through conduit 22 to a second three-way control valve 23. Control valve 23 is identical to valve 7 and is also actuated in response to operating conditions later to be described. The liquid flows through valve 23 and conduit 24 through first heat exchanger 55 in coil 56. At this point, the liquid is subjected to superheated gas in heat exchanger 55 and is heated to its upper most temperature prior to discharge through conduit 25 to a thermal energy storing device 28. Liquid then leaves thermal energy storage device 28 and flows past a temperature sensing device 30, through a pressure reducing valve 37, to conduit 4 from which it exits through liquid medium heater 35 to discharge conduit 36. Conduit 36 can be connected to any useful device for utilization of the heated liquid.

From the above description it is apparent that heat exchangers 55 and 59, connected in series, constitute a heat recovery system and associated valves 7 and 23 in conjunction with temperature sensor 30 and pressure sensor 54 all are a part of the control arrangement. Also included in the control arrangement is a recirculating fluid circuit including pump 21, control valve 23, conduit 26, conduit 27, thermal energy device 28, conduit 29, conduit 33, recirculating regulating valve 34, which proportions and returns fluid back to the inlet of pump 21 providing a closed fluid circuit. Regulating valve 34 permits a predetermined portion of fluid supplied through conduit 11 to be recirculated in the aforementioned circuit. This feature provides several advantages. Initially, it provides for preheating of liquid supplied through conduit 22 to control valve 23 and consequently to first heat exchanger 55. A second advantageous feature of the recirculating circuit is provision of a continual fluid supply to recirculating pump 21 preventing operation of the pump in a dry condition resulting in pump damage. Pump 21 also recirculates liquid through thermal energy storage means 28 maximizing heat transfer capability in first heat exchanger 55. Pump 21 performs a further function in acting as a booster increasing liquid pressure overcoming hydraulic losses in the liquid system. This increase in pressure is necessary to prevent an unbalancing of liquid medium flow in the liquid circuitry. Pump 21, in cooperation with recirculation and regulating valve 34, performs another function of significance. They both maintain a minimum pressure of liquid exposed in heat transfer relation to superheated gas while passing through coil 56 in first heat exchanger 55.

A conventional heat exchanger 39 with a flow control means or a pump 38 can be incorporated by conventionally known techniques into the re-circulating circuit as generally shown connected to conduit 33. This heat exchanger 39 transfers heat from the re-circulating circuit to either another liquid or a gas such as air. A liquid medium such as water has a boiling point which is dependent upon temperature and pressure. By increasing liquid medium pressure in coil 56, where the highest heat transfer temperatures occur, vaporization on the liquid can be prevented maintaining efficiency and safety of the system. Vaporization of liquid within the coil 56 necessarily results in an undesirable expansion which would directly decrease efficiency of heat transfer between superheated gas and the medium, such as water, flowing through coil 56. It also prevents possible damage to the system caused by so-called "water hammer" which is an expression for the rapid condensation of the vaporized liquid when it comes into contact with a colder liquid.

Temperature of the heated liquid supplied through conduit 32 to liquid medium heater 35 is regulated by the temperature sensing device 30. This device regulates the positions of valves 7 and 23 respectively through conventional electrical circuitry not shown. With regard to valve 23, liquid medium flow to heat exchanger 55 is regulated in response to prevailing temperatures sensed by temperature sensing element 30. Upon reaching a predetermined temperature, device 30 positions valve 23 to initially reduce flow through heat exchanger 55 maintaining the temperature of liquid supplied to the liquid medium system at a predetermined magnitude. In the event the temperture of liquid continues to increase, temperature sensing device 30 will proportionally and eventually close valve 23 to conduit 24 completely bypassing liquid through conduit 26. In the event bypass of heat exchanger 55 is insufficient to maintain liquid temperature as desired, sensing devie 30 will then actuate valve 7 and bypass a portion of the fluid flowing in conduit 5 to conduit 10. Should the liquid in discharge conduit 32 continue to have a temperature above a predetermined desired temperature, sensing device 30 will further actuate valve 7 and place both it and valve 23 in complete bypass modes eliminating flow to both heat exchangers 55 and 59. Temperature sensor 30 will keep the valves in this position until temperature returns to a desired level. Valves 7 and 23 are intentionally located near the bottom inlets of heat exchangers changers 59 and 55 and the outlets of the heat exchangers are intentionally located near the top of the units to avoid an accumulation of gas in heat exchange coils 56 and 60 in case of a boiling of the liquid medium.

With reference now to the refrigeration system supplying superheated condensible heat exchange medium, a minimum pressure differential across expansion device 79 is required for proper functioning of the system. To assure a sufficient pressure drop, pressure sensing device 54 is positioned in conduit 53 supplying superheated gas to the inlet of first heat exchanger 55. Pressure sensing device 54 is electrically connected with three-way valves 7 and 23 through conventional circuitry and is operative to override temperature sensing device 30 when it is necessary to actuate three-way valves 7 and 23. When gas pressure reaches a minimum allowable, pressure sensing device 54 first actuates three-way valve 7 diverting incoming cold liquid from conduits 8 and 9 in coil 60 into a bypass mode through conduits 5 and 10 taking heat exchanger 50 out of the heat recovery system. Should the resulting reduction of heat exchange capacity not be sufficient to prevent a further drop of gas pressure, pressure sensing device 54 then actuates regulating valve 23 into a bypass mode diverting liquid flow from conduit 24 and coil 56 so that flow is through conduits 22 and 26. This places heat exchanger 55 into a bypass mode out of the heat recovery system. In this manner a desired pressure drop across expansion device 79 is assured and the refrigeration system can continue to operate as though not associated with the heat recovery system.

A further feature of the subject control arrangement is the electrically connecting of three-way valves 7 and 23 with a motor starter of compressor 72. Discontinuance of operation of compressor 74, actuates three-way valves 7 and 23 into a bypass mode preventing migration of refrigerant in the refrigeration system to heat exchangers 55 and 59 which could cause start up problems for the refrigeration system. Continual cooling of coils 56 and 60 results in a pressure decrease of heated gas in heat exchangers 55 and 59 causing refrigerant to migrate to the heat exchangers creating start up problems on reenergization of compressor 72.

Three way valves 7 and 23 are also electrically controlled by float switch 47 which is connected with accumulator 44 and positioned to sense liquid level within the accumulator. During normal operating conditions, liquified gas leaves heat exchanger 59 through conduit 43 and is moved by refrigerant pump 42 through conduit 40 into receiver 77 for recirculation through the refrigeration system. The positioning of accumulator 44 below heat exchanger 59 permits gravity feed of liquid into the accumulator maintaining a pressure suction-head available at the inlet to pump 42. Equalizing conduit 46 relieves gas trapped in the top of liquid in accumulator 44.

In the event of a failure of refrigerant pump 42 or other malfunctioning circumstances in the heat recovery system, liquified gas could back up into heat exchanger 59 and on into heat exchanger 55 causing a malfunction of the entire refrigeration system. For this reason, float switch 47 is employed to sense levels of liquid in accumulator 44. When the level of liquified gas reaches a predetermined point, float switch 47 first switches three-way control valve 7 into a bypass mode. Should the liquid level fail to recede, float switch 47 will then actuate three-way valve 23 into a bypass mode. In this complete bypass mode, cold liquid medium from conduits 5 and 22 bypasses heat exchangers 59 and 55 preventing further liquification of refrigerant gas in the heat exchangers eliminating further supply of liquid to accumulator 44.

A further important feature of the control arrangement is the placing of normally open electrically controlled safety valves 6, 31, 41, 50, and 52 in all of the gas and liquid inlet and discharge lines 5, 32, 40, 51, and 53 respectively connecting the heat recovery system with the liquid medium and refrigeration system. In addition a noramlly closed valve 61 is provided in return line 74 of the refrigeration system and a normally closed check valve 3 is provided in liquid medium system conduit 2. a malfunction in the heat recovery system results in an immediate closing of valves 6, 31, 41, 50 and 52 through conventional electrical circuitry not shown automatically disconnecting the heat recovery system from both the liquid medium system and the refrigeration system permitting independent operation of each. Simultaneously, valve 61 and check valve 3 open permitting recirculation of refrigerant through conduit 74, condensor 75 and on to receiver 77. Opening of check valve 3 permits flow of liquid medium directly through conduit 4 to liquid medium heater 35 for discharge through line 36.

Normally closed checkout 3 has an additional function of a surge load relief valve. In case of a fluctuating liquid medium flow, the heat recovery system can be sized for optimum heat transfer conditions, which may be below a peak flow rate. Check valve 3 under these circumstanes will open during peak flow conditions and bypass a portion of fluid medium flow for effective operation of the heat recovery system.

The subject control arrangement permits an optional dual temperature tap of liquid medium by connecting conduit 12 to conduit 9. Conduit 12 will perform a similar function as conduit 36 but at a lower temperature level.

The foregoing describes a heat recovery system and a control arrangement which can be easily retrofitted onto existing refrigeration systems to utilize heat that is normally discharged into ambient atmosphere. Conduits 40, 51 and 53 can readily be tapped into a conventional refrigeration system for supply of a superheated condensible heat exchange medium to a heat recovery system including heat exchangers 55 and 59. Also a conventional liquid medium system, such as a water heating system, can readily be connected with the control arrangement by connection of conduits 5 and 32 with liquid conducting conduits 2 and 4. It can be seen that these connections will not seriously interfere with operation of the independent systems. Further with incorporation of the previously described control arrangement, the systems are instantly cut off from the heat recovery system in the event of a malfuntion. The control arrangement also provides advantages of maintaining the liquid at a predetermined temperature preventing vaporization while heat exchange is occurring. The incorporation of positive control devices such as pressure sensor 54 and float switch 47 ensure a proper pressure drop across expansion device 79 insuring normal operation of the refrigeration system. Temperature sensor 30 controls three-way valves 7 and 23 assuring discharge of liquid to the liquid medium system at a predetermined temperature.

It will be apparent to those skilled in the art that various modifications can be made to the control arrangement and recovery system of the instant invention without departing from the scope or spirit of the invention, and it is intended that the present invention cover modifications and variations of the system provided that they come within the scope of the appended claims and their equivalents.

What is claimed is:

1. A control arrangement for a heat recovery system comprising:

a fluid or gas medium system containing a fluid or gas to be heated;

a source of superheated condensible heat exchange medium;

a heat recovery system connected between said fluid or gas medium system and said heat exchanger medium system providing for transfer of heat from the superheated medium to fluid or gas in said fluid or gas medium system; and a control system responsive to said heat recovery system operating conditions wherein said control system provides multiple balancing and safety functions for said heat recovery system and said fluid or gas system and said superheated condensible heat exchange medium, said heat recovery system including a first heat exchanger and a second heat exchanger connected in series flow with both the superheated condensible heat exchange medium and the fluid or gas medium such that the respective mediums flow in opposite directions through both heat exchangers;

said superheated condensible heat exchange medium entering said first heat exchanger on an upper side and exiting on a lower opposite side from which it is conducted to an inlet on an upper side of said second heat exchangers and exits on a lower opposite side for return to said heat exchange medium system;

said fluid or gas medium being supplied to the lower side of said second heat exchanger and exiting the upper inlet side for transmission to the lower side of said first heat exchanger and exits the upper inlet side of said first heat exchanger for return to the fluid or gas medium system in a heated condition;

a first control valve placed in a fluid or gas supply line to said second heat exchangers;

a second control valve placed in a fluid or gas inlet line to said first heat exchanger;

a temperature sensing device positioned in a liquid exit line from said first heat exchanger regulating positions of said first and second control valves, thereby regulating temperature of liquid returned to said fluid or gas medium system;

a fluid or gas recirculation circuit connectd to a liquid exit line from said second heat exchanger, including in series;

a recirculating pump, said second control valve regulating fluid or gas flow to said first heat exchanger, a thermal energy storing means, and recirculating regulating valve;

said recirculating circuit maintaining a minimum fluid or gas pressure of fluid or gas supplied to said first heat exchanger preventing vaporization of the liquid circulated through said first heat exchanger;

said recirculating circuit also maintaining a sufficient pressure of a fluid or gas in the system compensating for normal hydraulic losses in the system;

said recirculating circuit further providing a continual flow of liquid to said recirculating pump preventing operation of said pump without fluid and consequent damage to said pump;

said thermal energy storage means bridging a time lag between damand and supply for heat recovered from said first heat exchanger by storing thermal energy and making it available to fluid at high demand conditions; and said regulating valve determining the amount of liquid recirculated, with the remaining portion being discharged to said liquid medium.

2. A control arrangement for heat recovery system as decribed in claim 1 wherein the predetermined volume of liquid circulating in the system by the discharged pressure of the circulating pump is passed through a thermal energy storage means for storing and releasing from and energy to the fluid or gas medium system;

the recirculating liquid necessarily having a temperature higher than the liquid supplied to the recirculating ciruit such that the proportional amount of fluid flowing in the recirculating system perheats inlet fluid to said first heat exchanger.

3. A control arrangement for heat recovery system as described in claim 1 further comprising:

a pressure sensing device measuring pressure of superheated condensible heat exchange medium supplied to said first heat exchanger;

said second control valve regulating inlet flow of fluid or gas to be heated to said first heat exchanger;

said first control valve regulating fluid or gas inlet flow to said second heat exchanger;

said pressure sensing device being connected to each of said control valves and operative upon occurrence of a predetermined pressure in the superheated condensible medium initially actuating said first control valve bypassing liquid past said second heat exchanger; and said pressure sensing device being further operative upon continuance of a predetermined pressure of the superheated medium actuating said second control valve bypassing liquid around first heat exchanger therby taking the heat recovery system out of said heat exchange medium system.

4. A control arrangement for a heat recovery system as described in claim 3 further comprising a temperature sensing device actuating said control valves and said pressure sensing device overriding said temperature sensing device bypassing liquid past said exchangers preventing adverse heat exchange medium system operating conditions.

5. A control arrangement for a heat recovery system as described in claim 1 further comprising:

pressure or electric sensing means responsive to discontinuances in operation of said heat exchange medium system actuating said first and second control valves by passing liquid around both said first and second heat exchangers preventing migration of refrigerant to said heat exchangers from said heat exchange medium system thereby preventing restarting difficulties.

6. A control arrangement for a heat recovery system as described in claim 1 further comprising:

a refrigeration pump in said heat exchange medium system;

said second heat exchanger discharging liquified gas to the inlet of said pump;

an accumulator connected between said second heat exchanger and said pump maintaining liquified gas flow for said pump;

a float switch responsive to liquified gas levels in said accumulator controlling said first and second control valves placing them in bypass modes in response to a maximum desired liquified gas level.

7. A control arrangement for a heat recovery system as described in claim 1 wherein the liquid leaving said second heat exchanger, being heated to a temperature lower than that of the liquid leaving said first heat exchanger being used for intermediate temperature applications.

8. A control arrangement for a heat recovery system as described in claim 1 wherein said recirculating circuit further includes at least one heat exchanger for transferring a portion of the heat from said liquid to another liquid or gas.

9. A control arrangement for a heat recovery system as described in claim 8 wherein said recirculating circuit further includes a means for compensating for normal hydraulic pressure losses in said heat exchanger.

* * * * *